United States Patent [19]

Beck et al.

[11] 4,309,253

[45] Jan. 5, 1982

[54] METHOD AND APPARATUS FOR TAR RECOVERY FROM RAW COKING GAS

[75] Inventors: Kurt-Günther Beck; Diethard Habermehl; Werner Kucharzyk; Werner Siebert, all of Essen, Fed. Rep. of Germany

[73] Assignees: Bergwerksverband GmbH; Didier Engineering GmbH, both of Essen, Fed. Rep. of Germany

[21] Appl. No.: 182,324

[22] Filed: Aug. 28, 1980

[30] Foreign Application Priority Data

Sep. 27, 1979 [DE] Fed. Rep. of Germany ..... 2939118

[51] Int. Cl.[3] ..... C10B 27/00

[52] U.S. Cl. ..... 201/30; 55/85; 55/222; 202/255; 208/340

[58] Field of Search ..... 201/26, 28, 29, 30; 202/254, 255, 256, 257, 258, 259, 260, 261; 55/80, 84, 83, 89, 222; 208/340, 344

[56] References Cited

U.S. PATENT DOCUMENTS

| | | | |
|---|---|---|---|
| 1,457,877 | 6/1923 | Doty | 55/89 X |
| 1,487,768 | 3/1924 | Torrey, Jr. | 55/89 X |
| 2,286,455 | 6/1942 | Becker | 55/85 X |

FOREIGN PATENT DOCUMENTS

| | | | |
|---|---|---|---|
| 2200607 | 7/1973 | Fed. Rep. of Germany | 202/261 |
| 2652499 | 5/1978 | Fed. Rep. of Germany | 55/85 |

*Primary Examiner*—Frank W. Lutter
*Assistant Examiner*—Roger F. Phillips
*Attorney, Agent, or Firm*—Michael J. Striker

[57] ABSTRACT

To increase the temperature at which a tar separator operates which separates tar from condensate obtained by cooling coking gas produced by coking preheated coal, the condensate is preheated by heat exchange with the coking gas entering a raw gas cooler and is then admitted into the coking gas collecting main of the coking ovens, from which it passes to the tar separator. A method and an apparatus are disclosed.

8 Claims, 1 Drawing Figure

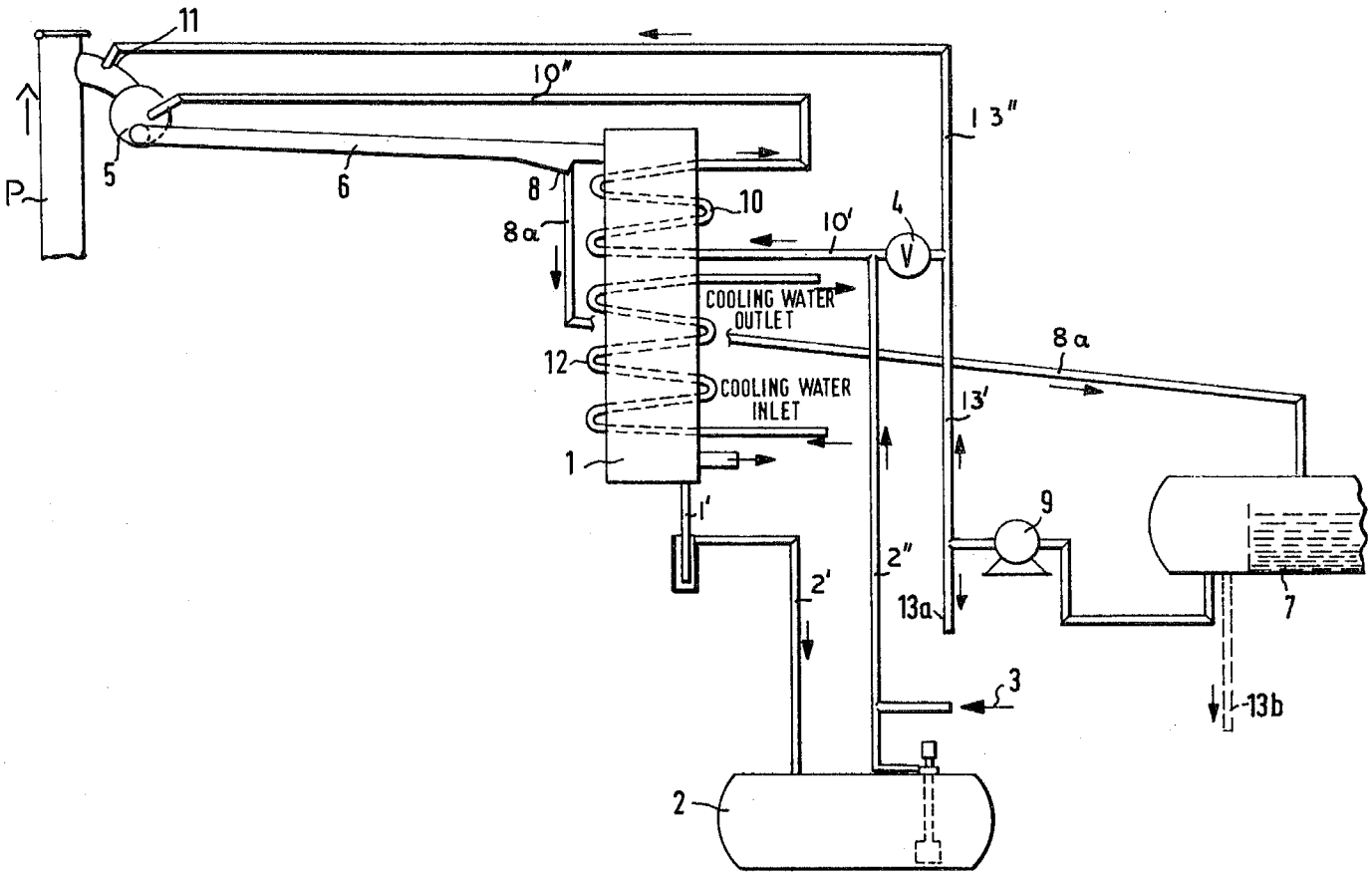
COOLING WATER OUTLET
COOLING WATER INLET
1
1'
2
2'
2"
3
4
5
6
7
8
8a
9
10
10'
10"
11
12
13a
13b
13'
13"
P

METHOD AND APPARATUS FOR TAR RECOVERY FROM RAW COKING GAS

BACKGROUND OF THE INVENTION

The present invention relates to the recovery of tar from raw coking gas.

More particularly, the invention relates to an improved method of recovering tar from the condensate of raw coking gas which is obtained by coking of preheated coal.

When coal is subjected to coking, a raw coking gas is obtained which contains, inter alia, hydrocarbons, inert gas components, water vapor and very fine solid particles. The gas, usually at a temperature of about 700°-800° C. and coming from the coking ovens, is collected in a raw gas main in which it is cooled by spraying cooling water directly into the main. This results in partial condensation and in a subsequently arranged tar separator the tar and solid components are separated out from the cooling water. The cooling water is constantly recirculated and losses are replenished by the addition of fresh water; the condensation stage has its own cooling water circuit.

The effectiveness of the tar separator is closely tied to the temperature of the condensate from which the tar and solid components are to be removed. The minimum acceptable operating temperature of the tar separator is about 75° C.; significant downward deviation, to e.g. 72° C., results in unsatisfactory operating results, which is to say that the water content in the separated tar will not be sufficiently low.

The customary practice heretofore has been to pump the separated water from the tar separator, or from the water collector of the same, directly to the raw gas main where it is in part sprayed into the main and in part into the riser-pipe elbows connecting the main with the riser pipes of the coke ovens, which is to say into the hot raw gas stream. As mentioned before, the raw gas has a temperature of about 700°-800° C.; due to its heat exchange with and the partial evaporation of the cooling water, the raw gas undergoes sudden, shock-like cooling to temperatures of about 100° C. and condensate forms in the raw gas main. The raw gas main is connected to a suction conduit via which the condensate is evacuated from it, by running along the bottom wall of the main and of the suction conduit. The part of the cooling water which is admitted directly into the main aids in this evacuation, since it forms at the bottom wall a liquid stream which facilitates the condensate outflow. This stream, composed of cooling water and condensate, is directed from the suction conduit to the tar separator.

The raw gas cooled in the main is forwarded to the raw gas cooler, which is a condensation stage cooled by appropriate heat exchangers, and from there is passed on to further processing stations. Condensate forming in the raw gas cooler is collected in a receptacle where it has a temperature of about 30° C.; thereafter it also is passed on to the tar separator. According to a variant of this prior-art method the condensate formed in the raw gas cooler and the condensate formed in the raw gas main and elsewhere, may first be recirculated into the raw gas main and only thereafter passed to the tar separator.

Under either of these prior-art operating conditions the overall heat balance of the total system causes an operating temperature of about 80° C. to develop in the tar separator if—and only if—the coal being coked has a moisture content on the order of about 10%.

Coal comes in a variety of different qualities; related to coke-making this means that some types of coke have much better coking ability than others. As with most resources, there has in the past been a tendency to use up the better-quality coals in preferences to the poorer-quality ones. However, coal is a non-renewable resource and in many areas of the world the better-quality coals—including coking coals—are becoming increasingly scarce. This has led to intensive research, as a result of which it has been shown that the coking abilities of poor-quality coal can be substantially improved if the coal is preheated prior to coking. This, in turn, leads to a reduction of its moisture content, to the point where moisture is either absent or present only in very small amounts. When such preheated coal is coked, very little coal-originated water vapor is available for condensation in the main and suction conduit and the thermal energy which is supplied by the generous vapor development in the coking of moist (e.g. about 10% moisture) coal is lacking. This thermal energy consequently cannot be supplied to the tar separator, so that in the coking of preheated coal—all other operating conditions being unchanged—the tar separator operates at a temperature of only about 72° C. Whereas temperatures higher than 75° C. are beneficial (best results are obtained at 80° C.), temperatures significantly lower than 75° C. (such as 72° C.) result in unacceptable operation. Moreover, the lack of adequate moisture causes other problems, such as a substantial concentration of chlorine compounds and other aggressive substances in the cooling water; this requires the constant addition of fresh water to the cooling water circuit to prevent these concentrations from reaching unacceptable levels. Evidently, the constant addition of fresh water further reduces the content of thermal energy in the cooling water circuit.

Yet, for the reasons explained earlier, the use of preheated coal is becoming increasingly important in the industry. Attempts have therefore been made to increase the tar separator temperature—recovery of tar as a coking by-product is, after all, an extremely important function—by supplying the requisite additional heat and moisture via the admission of hot steam from an external source, for example by admitting externally produced steam directly into the main. This is effective, but it requires the constant production and admission of external steam and results in a drastic reduction of operating economy for the entire process. It goes without saying, therefore, that this solution is disadvantageous, from the point of view of economy as well as from the point of view of energy efficiency.

SUMMARY OF THE INVENTION

It is, accordingly, an object of the invention to overcome the disadvantages of the prior art.

A more particular object is to provide an improved method of recovering tar from raw coking gas, which avoids the prior-art drawbacks.

Still a further object of the invention is to provide such an improved method which does not require external heat input in order to maintain and operate the tar separation stage at an advantageous temperature level.

A concomitant object is to provide an apparatus for carrying out the novel method.

Pursuant to the above objects, and still others which will become apparent hereafter, one feature of the invention resides in a method of recovering tar from raw coking gas. Briefly stated, this method may comprise the steps of precooling the raw coking gas on entry into a gas collecting main by contact with circulating cooling water and then passing it for further cooling through a raw gas cooler, with the condensate forming during the two cooling steps being supplied to a tar separator in which tar is separated from the water content of the condensate, wherein the improvement comprises preheating the condensate formed in the raw gas cooler by passing it into heat exchange with the raw gas entering the raw gas cooler; admitting the preheated condensate into the gas collecting main; and circulating it from the main to the tar separator.

The raw gas cooler is a heat exchanger through which the raw gas is passed so as to yield up a part of its heat energy to a cooling medium—usually water. In the area of the raw gas inlet the temperature prevailing in the cooler may be between about 75° C. and 100° C. (usually it is about 75°-85° C.). The temperature of the condensate formed in the cooler and of the raw gas issuing from the cooler is only about 30° C. The raw gas cooler operates in counterflow, i.e., the raw gas flows in a direction opposite to the movement of the cooling medium. According to the invention, this cooler is subdivided into two parts, the hotter section and the colder section, and the condensate which forms in the cooler is made to pass through the heat exchanger in the hotter section. As a result, this condensate is heated up above its otherwise usual temperature of 30° C.; it is then admitted into the main from where it travels into the tar separator which it enters at a temperature higher than that in the prior art.

The surprising result of this measure is that the tar separator temperature is raised to 75° C. or above, i.e., sufficiently high for satisfactory tar separation. It is now possible—without external heating—to obtain a water content of 1-2%/weight in the tar whereas at the lower operating temperatures of e.g. 72° C. which would obtain in the prior art without external heat supply, the water content in the tar is considerably higher, i.e. much less favorable.

Another advantage of the invention resides in the fact that the external cooling medium circuit of the raw gas cooler is required to provide less cooling capacity.

Fresh make-up water being added is advantageously passed—together with the condensate—through the heat exchanger in the hotter section of the raw gas cooler. As far as the cooling and flushing water used in the main and the suction conduit is concerned, which enters the tar separator and is collected in a reservoir, it has been found to be advantageous if a part of this water, also, is passed through the heat exchanger in the hotter section of the raw gas cooler.

The novel teachings which are considered as characteristic for the invention are set forth in particular in the appended claims. The invention itself, however, both as to its construction and its method of operation, together with additional objects and advantages therefor, will be best understood from the following description of specific embodiments when read in connection with the accompanying drawings.

BRIEF DESCRIPTION OF THE DRAWINGS

The single FIGURE is a somewhat diagrammatic illustration of an apparatus in accordance with the invention.

DESCRIPTION OF THE PREFERRED EMBODIMENTS

The novel method and apparatus will be conjointly discussed hereinafter with reference to the drawing.

Reference character P identifies a riser pipe in which raw gas produced by coking of coal in a not-illustrated coking oven, rises upwardly to enter the collecting main 5 via an elbow 11. There are, of course, many such pipes P connected with the main 5, even though only a single one is shown. From the main 5 the raw coking gas travels via conduit 6 to the raw gas cooler 1 which, according to the invention, is subdivided to have two cooling zones. Only the indirect (diagrammatically illustrated) heat exchanger 12 of the colder lower zone is fed with external cooling medium (usually water). The condensate which forms in the cooler 1 and is collected in reservior 2 via pipes 1' and 2', is fed via pipes 2'' and 10' into another indirect heat exchanger 10 of the upper, hotter zone of the cooler 1, to become heated by heat exchange with the incoming raw coking gas. It is then directly admitted into the main 5 via the pipe 10'' and from there passes via the conduit 6, the condensate trap 8 and the pipe **8*a* into the tar separator 7. There, it is separated from the tar and is in part made to pass—via pump 9, valve 4 and pipes 13', 10'—through the heat exchanger 10 and thereupon to return into the main 5 via pipe 10''. The remainder of the water separated in the tar separator 7 is passed via pipes 13', 13'' to the elbow 11 where it is sprayed into the hot raw gas coming from riser pipe P. From elbow 11 and main 5 the water of course returns again to the tar separator 7. Fresh (make-up) water is admitted into the system at 3 and is supplied to the heat exchanger 10 via pipe 2'', together with condensate from the reservoir 2. It is, however, evident that the make-up water could be admitted into the system elsewhere, i.e., not be introduced into the condensate flowing to the heat exchanger 10. Any excess water can be discharged from the system at any desired location, for example at 13*a* or 13*b***.

If desired, the condensate from reservoir 2, the make-up water 3 and the water separated in the tar separator 7 can all be brought together and can then be supplied via pump 9 and valve 4 in part to the heat exchanger 10 (and then the main 5) and in part to the elbow 11. Another possibility is to bring all these quantities of water together and jointly pass them through the heat exchanger 10 before supplying them in part to the main 5 and in part to the elbow 11.

For a better understanding the invention will now be described with reference to an example.

EXAMPLE

For purposes of this example, three tests were carried out, using a coke oven battery with a raw gas cooler. The conditions were identical in all three tests, except that (a) in Test 1, moist coal was coked and the raw gas was cooled in accordance with the prior art as hereinbefore described relative to the processing of raw gas from moist coal;

(b) in Test 2, preheated coal was coked and the raw gas was cooled in accordance with the prior art as hereinbefore described relative to the processing of raw gas from preheated coal;

(c) in Test 3, preheated coal was coked and the raw gas was cooled in accordance with the present invention.

TEST 1

In this test, moist coal was coked under the following conditions:

| | |
|---|---|
| Coal throughput through a battery of 50 coking ovens | 100t/h |
| Coal moisture | 10%/weight |
| Water of formation (resulting during coking from $H_2$ and air) | 3.5%/weight |
| Raw coking gas quantity | $330m^3/t$ (wt) i.N. |
| Raw gas temperature on entry into the raw gas main | 750° C. |
| Specific raw gas heat | $0.393 \frac{kcal}{kgK}$ (at 750° C.) |
| | $0.355 \frac{kcal}{kgK}$ (at 80° C.) |
| Heat content of water vapor in the raw gas | $940 \frac{kcal}{kg}$ (at 750° C.) |
| Flushing water for main and elbow, including make-up water | $5m^3$ per ton of coal used (wt) |
| Temperature reduction of the flushing water due to heat loss | 2° C. |
| Surface heat losses of the raw gas suction conduit | 2000 Mcal |
| The following temperatures were found in the raw gas condensation stage: | |
| Gas temperature just ahead of the raw gas cooler | 83.3° C. |
| Temperature in the tar separator | 80.2° C. |

TEST 2

This test was conducted in the same coke oven battery, but using pre-heated coal instead of moist coal. The coal throughput could be increased to 125t/h in this test, but the heat content of the coal moisture was lacking and only the heat content of the water of formation was present. The water of formation was of insufficient quantity to supply the flushing water and it was found necessary to add make-up water to the extent of 5% by weight of the coal used.

With operating conditions otherwise the same as in Test 1, the following temperatures were found in the raw gas condensation stage:

| | |
|---|---|
| Gas temperature just ahead of the raw gas cooler | 74.1° C. |
| Temperature in the tar separator | 72.4° C. |

The minimum temperature of 75° C. needed for proper tar separation was not reached.

TEST 3

This test was conducted in the same manner as Test 2, but the condensate formed in the raw gas cooler and make-up water (about 15% by weight of the coal used) were preheated in the heat exchanger of the hotter section of the raw gas cooler, before being admitted into the main and the elbows, respectively. The temperature of the thus preheated condensate and make-up water was found to be about 2° C. lower than the temperature of the raw gas on entry into the raw gas cooler.

The following temperatures were found in the raw gas condensation stage:

| | |
|---|---|
| Gas temperature just ahead of the raw gas cooler | 75.4° C. |
| Temperature in the tar separator | 75.3° C. |

Thus, the minimum temperature of 75° C. needed for proper tar separation was reached and exceeded without requiring the supply of externally produced energy, and due to the preheated condensate and make-up water the cooling capacity required to be supplied by the raw gas cooler is reduced as compared to the prior art. Both factors offer significant savings in energy without requiring the acceptance of reduced performance or quality.

While the invention has been illustrated and described as embodied in the recovery of tar from raw coking gas, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of recovering tar from raw gas produced by coking preheated coal, wherein the raw coking gas is precooled on entry into a gas collecting main by contact with circulating cooling water and is then passed for further cooling through an indirect raw gas cooler, the condensate formed during the two cooling steps including tar, water and solid components, wherein the improvement comprises preheating the condensate formed in the raw gas cooler by passing it into indirect heat exchange with the raw gas entering the raw cooler; admitting the preheated condensate into the gas collecting main; and supplying the preheated condensate from the main to a tar separator in which tar is separated from the water content of the condensate.

2. A method as defined in claim 1; further comprising the step of adding make-up water to the condensate and passing it therewith into heat exchange with the raw gas entering the raw gas cooler.

3. A method as defined in claim 1; and further comprising the step of adding a portion of the circulating separated water content to the condensate and passing it therewith into heat exchange with the raw gas entering the raw gas cooler.

4. A method as defined in claim 1; and maintaining the tar separator at a temperature of at least 75° C. due to the preheating of the condensate.

5. A method as defined in claim 1 further comprising circulating the separated water content into the main.

6. In an apparatus for recovering tar from raw gas which is produced by coking or preheated coal and is precooled and collected in a raw gas collecting main, a combination comprising a raw gas cooler having an inlet section receiving raw gas from the main and an outlet section; a first heat exchanger at said outlet section and adapted to receive a cooling fluid; a second heat exchanger at said inlet section and having inlet means and outlet means; a reservoir for collecting condensate which forms in said raw gas cooler; conduit means connecting said reservoir with said inlet means and said main with said outlet means, so that condensate from the reservoir is preheated in said second heat exchanger prior to entering said main; a tar separator in which tar is separated from liquid contents; means connecting said main with said tar separator so that the preheated condensate can flow from the main to the tar separator.

7. A combination as defined in claim 6; and further comprising means for admitting make-up water to said conduit means connecting said reservoir with said inlet means, so that the make-up water is preheated in said second heat exchanger together with the condensate.

8. An apparatus as defined in claim 6 further comprising means for circulating the liquid contents separated in the tar separator into said main.

* * * * *